US005722771A

United States Patent [19]

Wang

[11] Patent Number: 5,722,771

[45] Date of Patent: Mar. 3, 1998

[54] LAMP ASSEMBLY WITH WATER DRAIN

[76] Inventor: Jessica Wang, 16F-3, No. 70, Sec. 2, Tunha S. Road, Taipei, Taiwan

[21] Appl. No.: 659,569

[22] Filed: Jun. 6, 1996

[51] Int. Cl.[6] ..... F21V 29/00

[52] U.S. Cl. ..... 362/294; 362/249; 362/806

[58] Field of Search ..... 362/226, 249, 362/294, 373, 123, 806, 218

[56] References Cited

U.S. PATENT DOCUMENTS 4,999,751 3/1991 Chen ..... 362/226

5,498,922 3/1996 Chang ..... 362/249

5,541,818 7/1996 Ng et al. ..... 362/249

*Primary Examiner*—Y My Quach

*Attorney, Agent, or Firm*—Browdy and Neimark

[57] ABSTRACT

A lamp assembly includes a holder having a bore and a lamp having a base receivable within the bore of the holder. The holder has two symmetrical drain passages formed therein to extend to a bottom end of the holder so as to allow water to drain out of the holder through the passages. Each of the drain passages is defined by a slot formed on an inside surface of the holder and a slot formed on the lamp base and corresponding to and facing the first slot of the holder.

3 Claims, 3 Drawing Sheets

LAMP ASSEMBLY WITH WATER DRAIN

FIELD OF THE INVENTION

The present invention relates generally to a lamp assembly and in particular to a lamp assembly having water drain passages formed in the lamp holder to prevent accumulation of water within the lamp holder.

BACKGROUND OF THE INVENTION

Lamp strings have been widely used for decoration purpose in celebrations. The lamp strings comprise a number of small lamp assemblies connected together by means of electrical wires. Each of the small lamp assemblies comprises a holder attached to and in electrical connection with the electrical wires and a lamp having a base fit into and held within a bore formed on the holder to establish electrical engagement between the electrical wires and the filaments of the lamp. Such lamp strings are often arranged outdoors to decorate for example trees or fences. Such outdoor lamp strings are subject to the damage of weather conditions, for example rain and snow, and very often, water, such as rain drop and snow flakes, may get into and accumulated in the interior of the holder so as to cause short-circuiting problem. Short-circuiting may in turn cause fire. This is dangerous.

Thus, it is desirable to have a lamp assembly of which the holder is capable of water drainage so as to prevent accumulation of water therein.

SUMMARY OF THE INVENTION

It is therefore an object of the present invention to provide a lamp assembly comprising water drain structure to prevent water accumulation within the holder.

It is another object of the present invention to provide a lamp assembly which is capable to remove water flowing into the holder so as to prevent the lamp assembly from short-circuiting.

To achieve the above objects, there is provided a lamp assembly comprising a holder having a bore and a lamp having a base receivable within the bore of the holder. The holder and lamp have two symmetrical drain passages formed therein to extend to a bottom end of the holder so as to allow water to drain out of the holder through the passages. Each of the drain passages is defined by a slot formed on an inside surface of the holder and a slot formed on the lamp base and corresponding and facing the slot of the holder.

These and other objects and advantages of the present invention will become more apparent from a consideration of the following detailed description of preferred embodiments, when read in conjunction with the accompanying drawings, wherein:

DETAILED DESCRIPTION OF THE PREFERRED EMBODIMENTS

Figure 1:
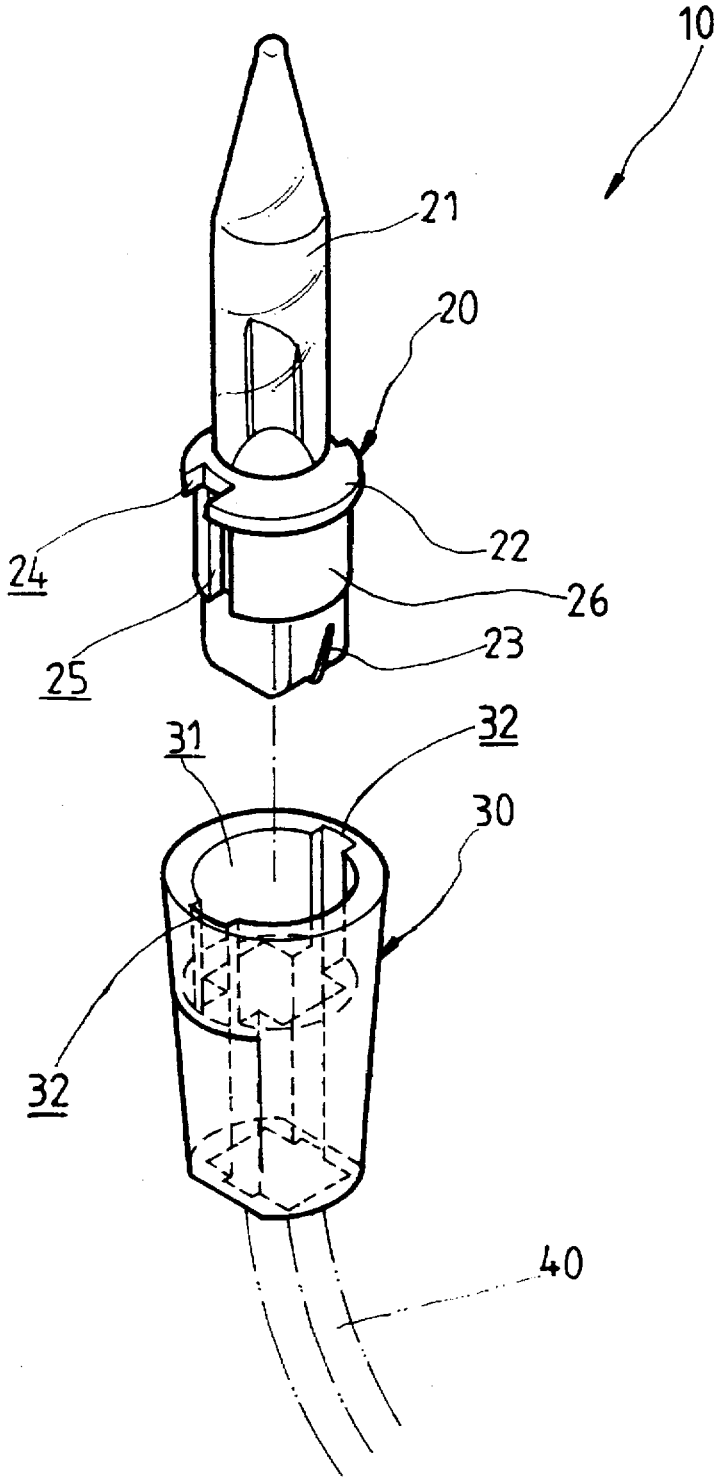
FIG. 1 is a perspective view showing a lamp assembly constructed in accordance with a first embodiment of the present invention with the lamp detached from the lamp holder.
Figure 2:
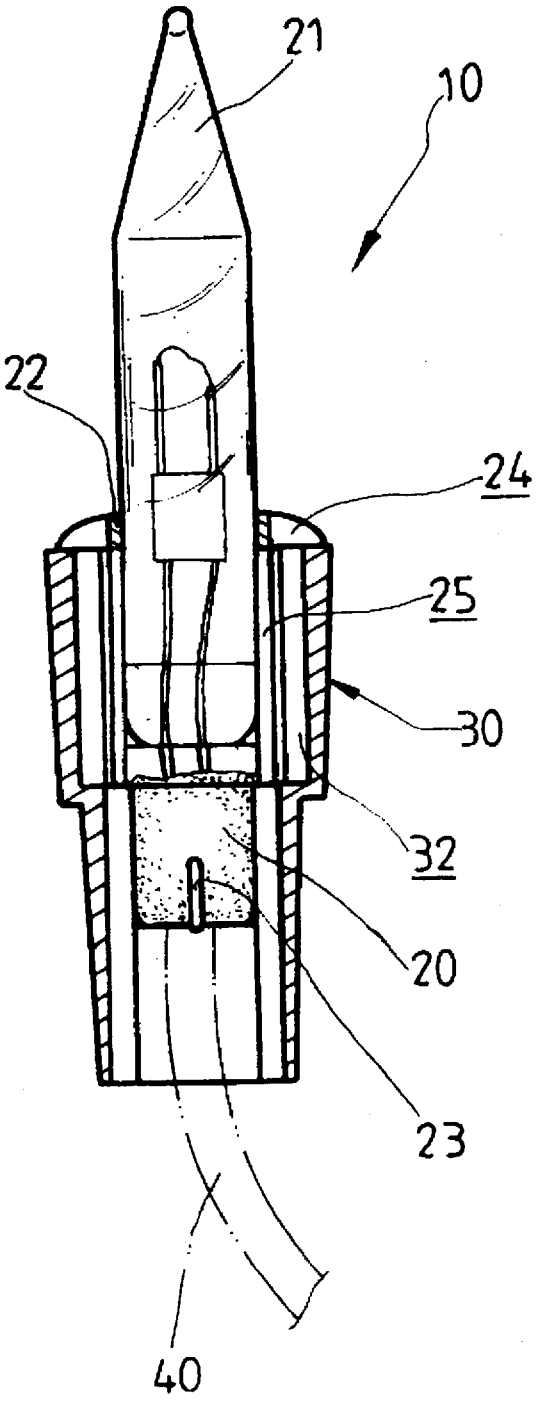
FIG. 2 is a cross-sectional view of the lamp assembly of the first embodiment of the present invention.

Referring to the drawings and in particular to FIGS. 1 and 2, wherein a lamp assembly constructed in accordance with a first embodiment of the present invention, generally designated with the reference numeral 10, is shown, the lamp assembly 10 comprises a holder 30 having a bore 31 formed thereon and a lamp 21 having a base 20 to be fit into the bore 31 of the holder 30.

The holder 30 has a top end on which the bore 31 is formed and an opposite bottom end through which electrical wires 40 extend into the bore 31 to be connected to contact pads (not shown) disposed inside the bore 31 of the holder 30.

The holder 30 has formed on an inside surface thereof a plurality of first slots 32, substantially parallel with a central axis of the bore 31 and extending from the top end thereof to the bottom end to define a plurality of drain channels extending completely through the holder 30. In the embodiment illustrated, there are two such first slots 32 symmetrical about the central axis of the bore 31 of the holder 30.

The base 20 of the lamp 21 comprises a circumferential flange 22 to be supported on the top end of the holder 30 for supporting the lamp 21 on the holder 30. A base body 26 extending from the flange 22 is dimensioned to be receivable within the bore 31 of the holder 30. Filament terminals 23 (only one visible in the drawings) extend out of the base body 26 to be in contact engagement with the contact pads located inside the holder 30.

The base 20 is provided with a plurality of second slots 25 on the base body 26 and extending substantially parallel with the central axis of the bore 31 and corresponding to the first slots 32 in number and location so that when the base 20 of the lamp 21 is fit into the bore 31 of the holder 30, each of the second slots 25 of the base 20 corresponds to and faces one of the first slots 32 of the holder 30 and thus they together define the drain channels for drainage of water therethrough.

The flange 22 of the base 20 has formed thereon a plurality of notches 24 each corresponding to one of the second slots 25 so as to define a top opening for each of the water drain channels defined by the first and second slots 32 and 25. With such an arrangement, rain drops or snow flakes there are falling on the lamp can be drained through the drain channels without accumulation within the holder 30.

Figure 3:
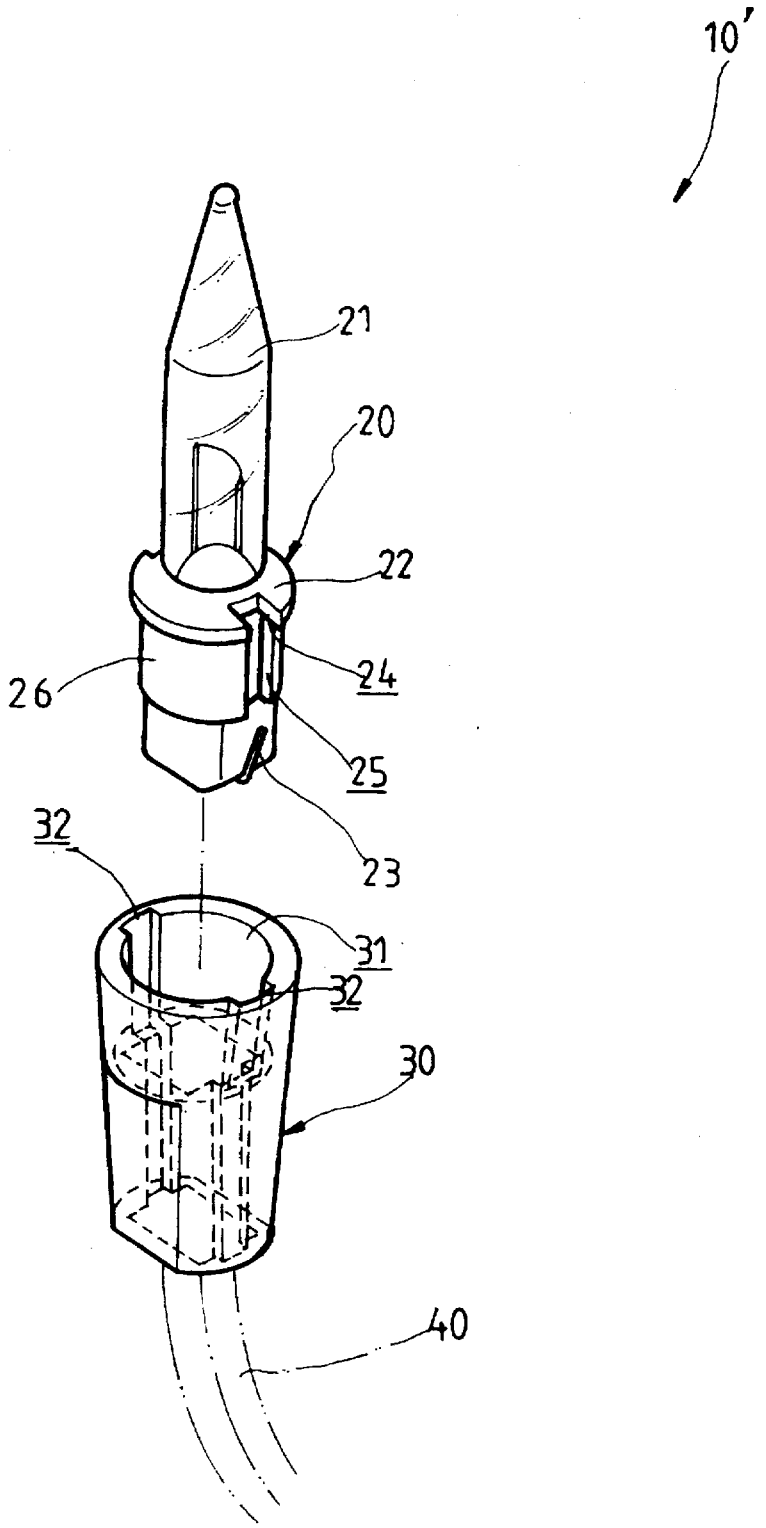
FIG. 3 is a view similar to FIG. 1 but showing a second embodiment of the lamp assembly in accordance with the present invention.

In the first embodiment illustrated in FIGS. 1 and 2, the drain channels (namely, the second slots 25 of the base 20 and the first slots 32 of the holder 30) are arranged so that the locations of the drain channels are angularly spaced from the filament terminals 23, preferably by an angle of 90 degrees in the case when there are only two such drain channels. It is possible to arrange the drain channels in such locations corresponding to the filament terminals 23, as shown in a second embodiment of the lamp assembly, which is designated 10' as illustrated in FIG. 3 in which the same reference numerals indicate the same elements in FIGS. 1 and 2.

In both cases, the water drops that fall onto the lamp assembly 10 or 10' will be drained through the drain channels. This overcomes the problem of water accumulation within the lamp holder and the short-circuiting caused by the water accumulation within the holder 30.

Those skilled in the art will readily recognize that various modifications of the present invention may be made without departing the scope of the present invention defined in the appended claims. Accordingly the embodiments illustrated and discussed herein should be understood to be exemplary only in nature and the scope of the instant invention should be limited only by that of the following claims.

What is claimed is:

1. A lamp assembly, comprising a holder having a bore and a lamp having a base receivable within the bore of the holder, at least one drain passage formed within the holder to extend to a bottom end of the holder so as to allow water to drain out of the holder through the drain passage;

wherein the drain passage comprises a first slot formed on an inside surface of the holder which extends to the bottom end of the holder and a second slot formed on the base which extends along and facing the first slot of holder so as to define the drain passage.

2. The lamp assembly as claimed in claim 1, wherein the base comprises a circumferential flange to be supported on a top end of the holder, the flange having a notch corresponding to the second slot of the lamp base to serve as an opening of the drain passage.

3. The lamp assembly as claimed in claim 1, wherein the holder comprises two drain passages arranged symmetrical about a central axis of the bore of the holder.

* * * * *